US005288361A

United States Patent [19]

Konno

[11] Patent Number: 5,288,361

[45] Date of Patent: Feb. 22, 1994

[54] APPARATUS FOR SPLICING OF A CONTINUOUS PACKAGING WEB

[75] Inventor: Hidetoshi Konno, Yokohama, Japan

[73] Assignee: Tetra Pak Holdings SA, Pully, Switzerland

[21] Appl. No.: 796,978

[22] Filed: Nov. 25, 1991

[30] Foreign Application Priority Data

Nov. 27, 1990 [JP] Japan ..... 2-327861

[51] Int. Cl.[5] ..... B65H 21/00

[52] U.S. Cl. ..... 156/353; 156/504; 156/505; 156/510; 242/58.5

[58] Field of Search ..... 156/304.3, 353, 504, 156/505, 510, 159; 242/58.3, 58.5

[56] References Cited

U.S. PATENT DOCUMENTS

| | | | |
|---|---|---|---|
| 3,939,032 | 2/1976 | Taitel et al. | 156/505 |
| 4,190,483 | 2/1980 | Ryan et al. | 156/504 |
| 4,443,291 | 4/1984 | Reed | 156/504 |
| 4,769,098 | 9/1988 | Cederholm et al. | 156/159 |
| 4,923,546 | 5/1990 | Wheeler et al. | 156/159 |
| 5,064,488 | 11/1991 | Dickey | 156/159 |
| 5,066,345 | 11/1991 | Long et al. | 156/159 |

FOREIGN PATENT DOCUMENTS

| | | |
|---|---|---|
| 59-51031 | 3/1984 | Japan . |
| 2-152640 | 6/1990 | Japan . |

*Primary Examiner*—W. Gary Jones

*Attorney, Agent, or Firm*—Armstrong, Westerman, Hattori, McLeland & Naughton

[57] ABSTRACT

An automatic connecting apparatus for continuous packaging, having a braking mechanism for braking a terminal of a belt-shaped product at a braking position located near a conveying pathway of the belt-shaped product, with the belt-shaped product having packaged items which are packaged in bulged sections at regular pitch intervals. The apparatus also has a detection device coupled to the braking mechanism, for detecting the terminal end of the belt-shaped product. A positioning mechanism positions the terminal end at a prescribed position downstream from the braking position of the belt-shaped product, with interactive movement between the bulged sections and an interacting piece. A cutting mechanism is provided for cutting and separating a terminal end, and forming and pressing a new terminal end. A starting-end positioning device is provided for positioning the starting spare belt-shaped product so that it can be connected to the terminal end of the old belt-shaped product.

13 Claims, 4 Drawing Sheets

APPARATUS FOR SPLICING OF A CONTINUOUS PACKAGING WEB

BACKGROUND OF THE INVENTION:

1. Field of the Invention:

The present invention relates to an automatic connecting apparatus for continuous packaging that enables continuous supply operations for attaching devices of individual packages from continuous packaging without interruption. An example of such an apparatus is a straw-attaching device where continuous packaging, consisting of rod-shaped product such as beverage straws is continuously packaged at regular intervals.

2. Description of Related Art:

Paper containers shown in FIG. 8, called package containers, are typically used as commercial containers for juice-type beverages. For the sale of juice in this type of container (P), a straw (B) is an accessory to the container (P) and is packaged for sanitary purposes and attached as a package (A). The packaging of the straw (B) forms a belt-shaped product (D) shown in FIG. 7, where two sheets of belt-shaped film continuing lengthwise wrap straws (B) in the width direction at regular intervals. This belt-shaped product (D) is paid out of a roll (which typically has a larger diameter than shown in the figure when the machine is first loaded), and the attaching operation is automatically performed by separating the belt-shaped product (D) at the fused sections (C) between adjacent straws. The separate straws (B) are then attached to the containers (P) as individually wrapped packages.

The belt-shaped product in continuous packaging form is loaded on the machine as a roll and sequentially paid out and fed to a cutting device. However, supplying new belt-shaped product after the entire roll of belt-shaped product is depleted typically requires the temporary shutdown of the machines. Therefore, the feeding operation could not be continuous, and the shutdown invariably leads to a drop in operating efficiency.

To resolve the above problems, an automatic connecting apparatus for continuous packaging has previously been proposed in Jap. Pat. App. Sho 57-161766, and disclosed in Jap. Pat. Pub. Sho 59-51031. In these devices, a forced feeding roller is installed along the conveying pathway of belt-shaped continuous packaging and rotates faster than the pay-out velocity of the product to be packaged. Upon the detection of the terminal end of the continuous packaging, the force-feeding roller is rotated quickly to create slack for the continuous packaging ahead of the roller. The starting end of a new, spare belt-shaped product is set on an arc-shaped platform at the rear of the force-feeding roller, and a press roller, established between the force-feeding roller and conveying pathway to engage and disengage from the force-feeding roller is transferred to the rear along the outer circumference of the arc-shaped platform along the upper surface of the final end of the belt-shaped product. The terminal end of the exhausted packaging can connect to the starting end of the aforesaid new continuous packaging.

Another continuous supply method and apparatus of continuous straw packages is disclosed in Jap. Pat. App. Sho 63-302511 (Jap. Pat. Pub. Hei 2-152640). This method teaches that straws are cut during transfer from continuous straw packaging maintained on the outer circumference of a drum and transferred from the rotating drum to container-adhering positions for transferring while continuous straw packaging is paid out to the rotating drum from a supply roll. During the retention on the outer circumference and rotated transfer of the rotating drum, the roll on stand-by retains the leading end of continuous straw packaging at the side of the rotating drum by a retaining means. When the continuous straw packages finish spooling their supply to the rotating drum, the retaining means is brought near the rotating drum to hand over and hold the leading end of the continuous straw packages on stand-by for the outer circumference of the rotating drum to enable continued pay-out and supply of the packages.

The automatic connecting apparatus for continuous packaging pertaining to the first application proposal (JP 59-51031) automatically and efficiently performs connecting of the final end (terminal end) of exhausted belt-shaped product and starting end of new belt-shaped product, whenever the paid out belt-shaped product approaches the end of a supply roll. Because connection proceeds with a final section near the core of the roll, however, a strong curl or a poor shape at the final end prevents correct fitting into the packaging slots (straw slots) established at a regular pitch on the arc-shaped platform. This fitting problem results in poor connections and considerable other problems resulting from undependable or defective connections.

The automatic connecting apparatus for continuous packaging pertaining to the second application (JP 63-302511) proposal cannot supply continuous straw packaging on machines which do not employ a rotating drum. When straws are applied to containers from a rotating drum, however, transfer of the leading end of the continuous straw packaging to the outer circumference of the rotating drum must be successful. If not, the application of straws to the containers will be incomplete and inconsistent, as some containers will not have straws.

The present invention is intended to cure the deficiencies which exist in current devices and systems in this art. The invention is directed to an automatic connecting apparatus for continuous packaging, which does not specifically require a rotating or cutting drum. The invention ensures that every container receives a straw, and connection problems due to curling when the final end (terminal end) of continuous packaging and the starting end of new continuous packaging are connected, are completely eliminated.

SUMMARY OF THE INVENTION

To achieve the objectives, the automatic connecting apparatus for continuous packaging according to the present invention includes braking means for braking a terminal end of a belt-shaped product at a braking position located near a conveying pathway of the belt-shaped product, the belt-shaped product having packaged items which are packaged in bulged sections at regular pitch intervals;

detection means coupled to the braking means for detecting the terminal end of the conveyed belt-shaped product;

positioning means for positioning the terminal end at a prescribed position downstream from the braking position of the belt-shaped product by tensioning and positioning the terminal end of the belt-shaped product, with interactive movement between the bulged sections and an interacting piece;

cutting means for cutting and separating the terminal end, forming a new terminal end, and pressing the new terminal end, the cutting means cutting and separating the terminal end of the positioned belt-shaped product by movement of a mobile cutting piece, retaining the position of the new terminal end and orthogonally displacing it in a conveying direction, thereby pressing and connecting said new terminal end onto a starting end of a spare belt-shaped product; and starting-end positioning means for the spare belt-shaped product for positioning the starting end of the spare belt-shaped product, the starting end positioning means being located adjacent to the braking means, and including a cutting section to cut the starting end of the belt-shaped product, wherein the starting end positioning means positions the starting end by a suction, such that the new terminal end of the belt-shaped product can be connected thereto.

The braking means for the terminal end of the belt-shaped product further includes a detection device for the belt-shaped product terminal end; a braking and positioning roller disposed to contact the belt-shaped product between the bulged sections at regular pitch intervals; and a driving means for driving the braking means, the driving means activated in response to signals from the detecting device, wherein the braking and positioning roller freely advances and recedes at the pathway via spring means.

The terminal-end positioning means includes interacting means for interacting with and moving the bulged sections in the conveying direction, the interacting means being driven diagonally relative to the conveying direction of the belt-shaped product; and a mobile piece disposed to reciprocate in a direction parallel to a conveying direction of the belt-shaped product, wherein the interactive means is mounted to a leading edge of said mobile piece; and a retaining piece disposed adjacent to the conveying pathway, said retaining piece freely advancing or receding by pressure from a spring, wherein the retaining piece is facingly opposed to the interacting piece, wherein the interacting piece and said mobile piece tensions and positions the belt-shaped product, while forming a slack portion of belt-shaped product beyond the terminal-end positioning means.

The cutting means includes a fixed blade and a mobile blade on opposing sides of the conveying pathway of the belt-shaped product, wherein the mobile blade is fastened to a mobile cutting piece which reciprocates orthogonally relative to the conveying direction, the mobile cutting piece having multiple slots of a prescribed pitch disposed to accommodate the bulged sections, and accommodates a cut and formed new terminal end of belt-shaped product to enable pressing onto the starting end of the spare belt-shaped product between the mobile piece and said retaining piece while simultaneously shearing the belt-shaped product.

The starting end positioning means for the spare belt-shaped product comprises: a suction surface parallel and facing the conveying pathway, the suction surface for positioning and holding by suction the cut starting end of the spare belt-shaped product having cellophane tape attached thereto; a second surface with multiple slots of a prescribed pitch thereon, the multiple slots for accommodating the bulged sections of the spare belt-shaped product, said second surface also having a cutting slot formed thereon to cut and form the starting end of belt-shaped product at prescribed positions between the said slots.

BRIEF DESCRIPTION OF THE DRAWINGS

For a complete description of a preferred embodiment of the invention, reference should be made to the following description and the accompanying drawings, wherein.

DESCRIPTION OF THE PREFERRED EMBODIMENT

Figure 2:
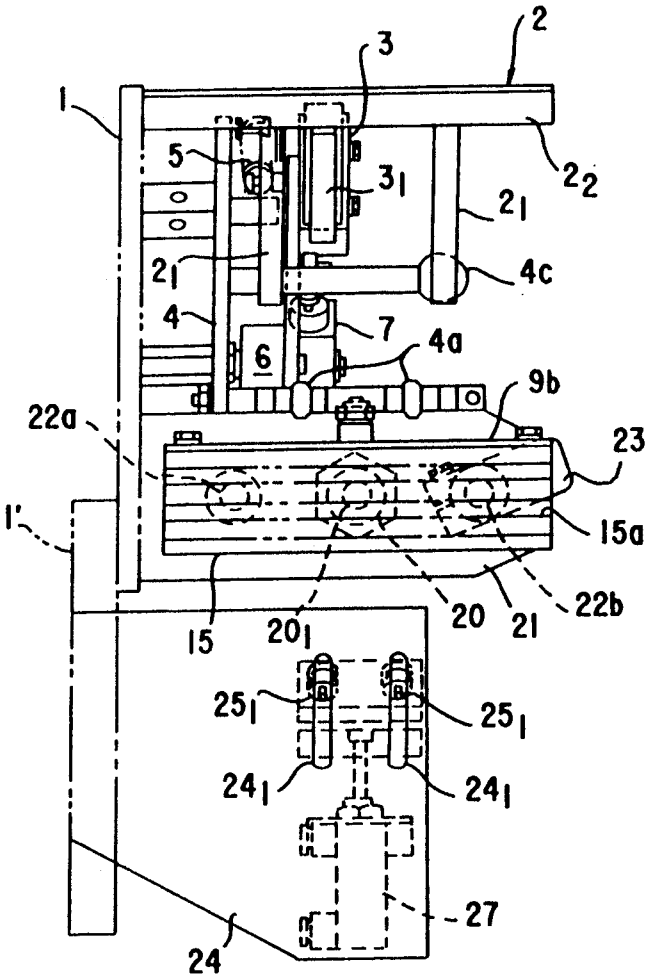
FIG. 2 is a rear view along line I—I of FIG. 1 of the claimed invention.

In this description, straws for attaching to a commercial container of juice, etc., to be packaged by continuous packaging are discussed as an illustrative example of the invention. The present invention, however, is not limited to this example, and may be used for plastic spoons used for yogurt, gelatin, etc., or similar applications.

Referring to FIGS. 1, 2, and 5A and 5B, guide pieces (2), (2) as a left-right pair are installed parallel on the front of vertical support plates (1), (1') installed on part of the main unit. The space between both guide pieces (2), (2) is the conveying pathway of the belt-shaped product (D), which is the continuous packaging. Near both guide pieces (2), (2), a conventionally known micro switch is installed as a detection device (3) that can detect the terminal end of belt-shaped product (D), successively paid out and passing between the guide pieces. Both guide pieces (2), (2) consist of a pair of bars ($2_2$), ($2_2$) which are bevelled on the upper surfaces and have a pair of guide rods ($2_1$), ($2_1$) attached thereto (see FIG. 2).

Between the guide rods ($2_1$), ($2_1$), the detection lever ($3_1$) of the micro switch, which is the detection device, is placed in the pathway of the belt-shaped product (D). An electrical signal applies the brakes to stop the movement of belt-shaped product and is emitted from the micro switch when the terminal end of the belt-shaped product (D) passes. The sides of both guide pieces (2), (2) (upper right in FIG. 1) provide for bearing the shaft support (**4*b*) of the braking and positioning lever (4) on the support plates to swing freely as the terminal-end braking means (10) of the belt-shaped product, in order to brake and position the conveyed belt-shaped product (D). Guide pieces (2**) also perform the function of attaching the shaft of the braking and positioning roller (4a) at the lower end of the said lever (4), and also rotating the lever (4) clockwise via spring (5) at the upper end.

A manual lever knob (4c) is attached to the lever at a prescribed position below the shaft support (4b). When the belt-shaped product (D) is positioned initially on the pathway, the roller can be manually removed from the pathway. The air cylinder (7) activates the braking and positioning lever and is supported by a shaft 7(b) on the support plate (1) at the prescribed position to the right of the lever (4). Shaft ($6_1$) on the middle part of a linking lever (6) supported by shaft (6b), above the support plate (1) is attached to the lower part of the cylinder's position linking rod ($7_1$). This shaft drives the braking and positioning lever (4) with spring (5) from the upper end of the lever.

Facing the lower path of the pathway of belt-shaped product (D), specified by both guide pieces (2), (2) and below the left guide rod ($2_1$), is a support block (8) with a prescribed pathway length to support and guide belt-shaped product (D) when positioning roller (4a) presses the belt-shaped product (D). The signal detecting passage of the terminal end of the belt-shaped product from the detection device (3) activates cylinder (7) and enables the linking lever (6) to rotate clockwise and the braking and positioning lever (4) to rotate similarly clockwise via the spring (5). At this point, brakes are applied to the terminal end of belt-shaped product (D) by fitting and pressing the positioning roller (4a) below the linking lever between the mutually adjacent bulged sections of the moving belt-shaped product, and thus position and stop the portion of the terminal end to be cut. At the lower end face of support block (8) is fastened an upper fixed blade (9a), whose blade for cutting the belt-shaped product is sloped or angled in the width direction. A lower mobile blade (9b) is fastened on the upper surface of press block (15), and moves orthogonally relative to the pathway of the belt-shaped product. This upper and lower blade combination forms the cutting means, for cutting and separating the terminal end and pressing the new terminal end, designated as item (11). The prescribed positions between the bulged sections of the belt-shaped product which has been braked and stopped are cut between the fixed and mobile blades.

Press block (15) faces the pathway of the belt-shaped product (D) and is furnished with a slotted rubber section (15a) to press and join the newly formed terminal end of the belt-shaped product (D) to the connecting part of the starting end (d') of spare belt-shaped product (D'). Cellophane tape (T) is attached either manually or by other suitable means, and the adhesive surface thereof slightly protrudes from the lip of the starting end on the back face of the said starting end (d') (see FIG. 4). The press block (15) is fastened to the piston rod ($20_1$) of an air cylinder (20) which is installed on a frame whose installation projects forward from the support plate (1'). The press block reciprocates freely between the prescribed length orthogonally to the belt-shaped product pathway. The slotted rubber section (15a) consists of silicone rubber with a Teflon film covering on the outer surface thereof, and is furnished with multiple slots at prescribed positions corresponding to the bulged sections of the belt-shaped product, to enable effective joining of the belt-shaped product during pressing. Guide rods (22a), (22b) are installed to the left and right of the piston rod ($20_1$) next to the press block. Forward guide rod (22b) has a vacuum release lever (23), installed to release the vacuum suction of the vacuum plate (28) in the positioning piece for spare belt-shaped product, which is described herein. The vacuum release lever presses a vacuum valve (not illustrated) when the press block (15) has travelled to the left end. The pressing of this valve stops vacuum suction of the vacuum plate (28), to enable the joined belt-shaped product (spare belt-shaped product portion) to be easily peeled away from the vacuum plate (28), and moved either manually or by other suitable means to the conveying pathway for belt-shaped product (the pathway in use).

Figure 6:
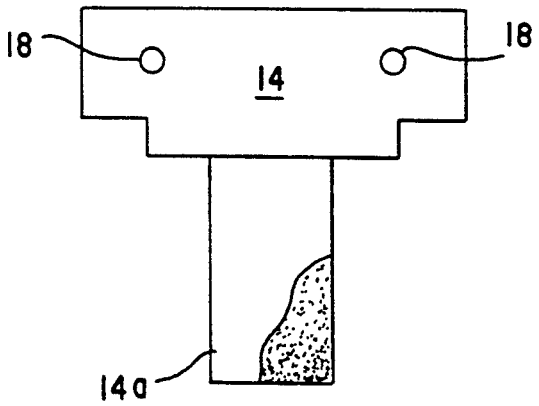
FIG. 6 is A front view of the retaining surface of the retaining piece.
Figure 7:
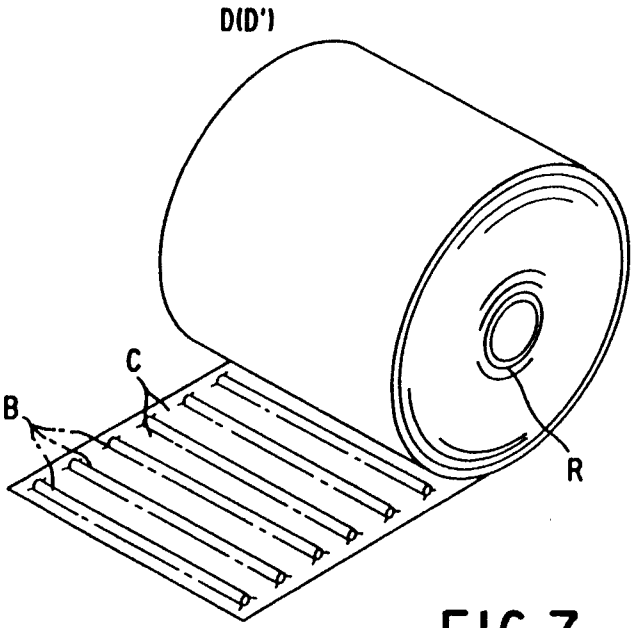
FIG.7 PRIOR ART
FIG. 7 is a perspective of a continuous roll of belt-shaped product.
Figure 8:
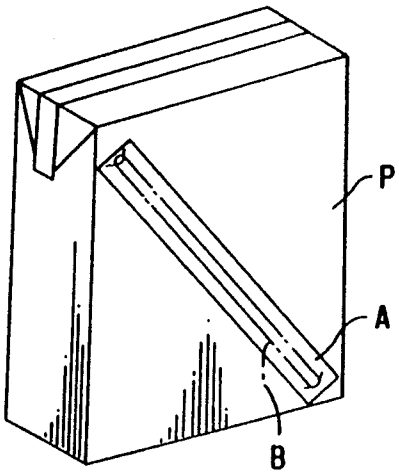
FIG.8 PRIOR ART
FIG. 8 is a view of a juice or beverage container with a packaged straw attached thereto.

Retaining piece (14) is located a prescribed distance below fixed blade (9a), and is for holding the new terminal end portion of belt-shaped product after cutting, when press block (15) is pushed against the belt-shaped product. Retaining piece (14) also guides the new terminal end along the conveying pathway of the belt-shaped product, and is fastened and installed on the ends of a pair of left and right guide rods (18) , (18) in the width direction of belt-shaped product guided to the guide block (16) (see FIG. 6) . The front retaining face of the retaining piece (14) is ordinarily located along the conveying pathway of the belt-shaped product according to the action of a spring (17) coiled on the guide rod between retaining piece (14) and guide block (16) and applied to a stopper (19) fastened to the rear end of the rod. When the press block is driven (travel to the left in FIG. 1), the retaining piece (14) recedes and the front retaining face comes to essentially the same plane as the vacuum surface of vacuum plate (28) of the positioning piece for the starting end of spare belt-shaped product (13). The upper part of the retaining piece (14) is configured to opposingly face the slotted rubber section (15a) of press block (15). The lower part stably holds the belt-shaped product between interacting pins ($25_1$).

Interacting pins ($25_1$) are the interacting pieces which tension and position the terminal end of the belt-shaped product. These pins interact with the bulged sections of belt-shaped product and moves below (hooks the bulged sections) , to stop the belt-shaped product (D) after the upper part has been braked and stopped. The lower part of the retaining piece 14 includes a flat rubber piece (14a) of a prescribed width which corresponds to the interacting pins in a width direction. Rubber piece (14a) preferably is fabricated with a sponge rubber inner portion whose surface is covered with a teflon or equivalent type of covering (see FIG. 6) which is intended to prevent damaging the belt-shaped product when the interacting pins move downward.

The means (12) to tension and position the terminal end of the belt-shaped product is installed below press block (15) at its normal position. This position is above guide plate (24), having a prescribed shape, facing the lower front surface (right side face of retaining piece (14) shown in FIG. 1) of the retaining piece (14) at its normal position. The pair of interacting pins ($25_1$) are installed to advance and recede freely in the diagonal downward direction, from a small cylinder (25) which is mounted to slide block (26), through the back surface of guide plate (24). Slide block (26) is fastened to a piston rod ($27_1$) of air cylinder (27) which is attached to the lower back surface of guide plate (24). Pins ($25_1$) protrude through guide plate (24) via a pair of elongated holes ($24_1$), ($24_1$). The interacting movement downward for the interacting pins ($25_1$) is oriented toward the conveying pathway of the aforesaid belt-shaped product. The movement consists of driving the air cylinders (25), (27) sequentially to project the interacting pins ($25_1$), such that the pins interact with the bulged sections of the belt-shaped product, and air cylinder 27 lowers the pins and the bulged sections. This movement occurs when the terminal end of the belt-shaped product (D) in use is detected and the terminal end is braked and stopped.

Starting-end positioning piece (13) is disposed on an opposite side of the pathway of the belt-shaped product from the terminal-end braking means 10, and remains a predetermined distance from support block 8. Starting-end positioning piece 13 forms the starting end (d') of spare belt-shaped product which is to be connected to the new terminal end of the belt-shaped product in use (see FIGS. 1 and 5).

Figure 4:
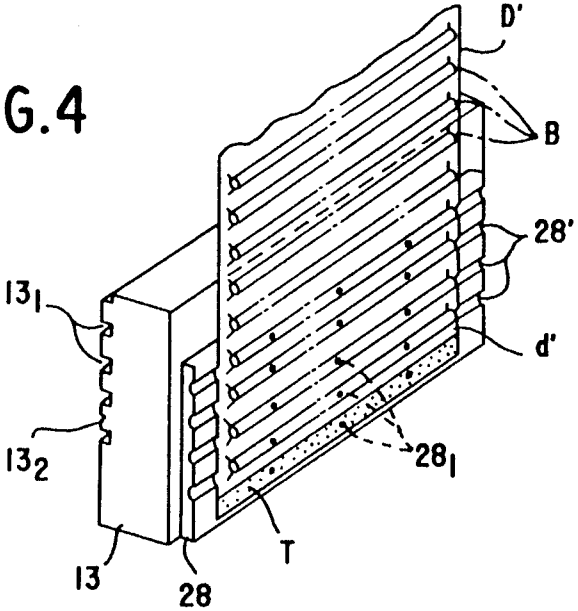
FIG. 4 is a view of the standby condition of the starting end, being held by suction at the starting end positioning means.
Figure 5A:
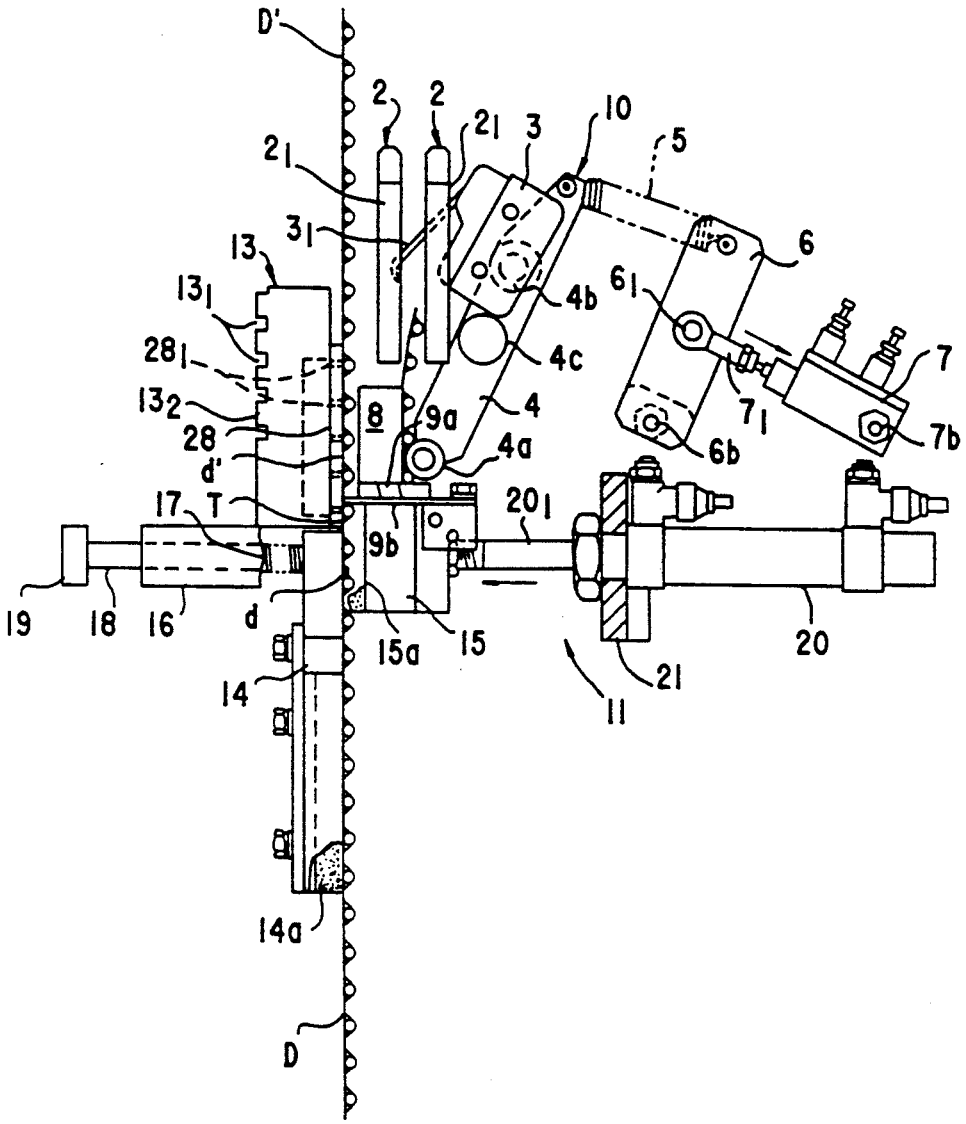
FIG. 5A is a front view of the invention, similar to FIG. 1, where the device is in operation on the spare belt-shaped product joining the starting end to the terminal end.
Figure 5B:
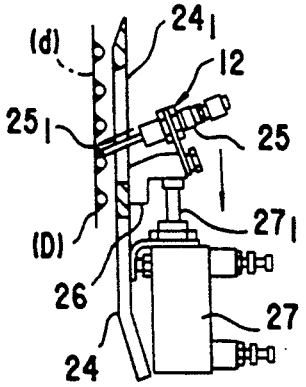
FIG. 5B is a front view of the positioning means of the present invention.

As shown in FIG. 4, starting-end positioning piece (13) of the spare belt-shaped product (D') includes multiple slots ($13_1$), ($13_1$) for inserting and positioning the bulged straw sections of the starting end of spare belt-shaped product on the back face of a block. The block has a prescribed height and thickness, and the width is slightly larger than the width of the belt-shaped product. Cutting slot ($13_2$) is provided on the projecting section between mutually adjacent slots on the lower part extending in the width direction, to cut the flat sections between the lower bulged sections of the belt-shaped product.

Figure 3:
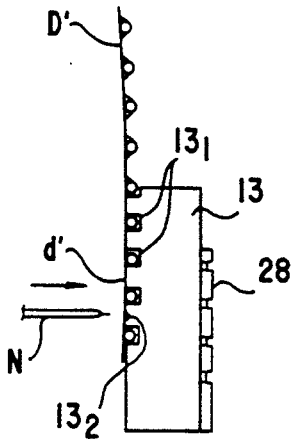
FIG. 3 is a front view showing the cutting and forming of the starting end of the spare belt-shaped product.

In use, the starting-end positioning piece (13) of the spare belt-shaped product allows the bulged straw sections of the starting end of spare belt-shaped product to fit in between the slots ($13_1$), ($13_1$) first, whereby cutting blade (N), or a similar device, is employed to cut the prescribed position between the bulged sections with the cutting slot ($13_2$) and forms a new starting end (d') for connecting to the terminal end (see FIG. 3).

On the back side of the new starting end thus cut and formed, cellophane tape (T) is attached, either manually or by other suitable means, slightly protruding from the lip of the starting end section (see FIG. 4). On the side opposing the back surface of the support block on the reverse side of the aforesaid slots ($13_1$), ($13_1$) of the starting-end positioning piece (13), a vacuum plate (28) is installed to hold by suction and position the lower end of the spare belt-shaped product (D') . The vacuum plate is indented with small, circular-arc-shaped, shallow slots (281) on its surface at positions corresponding to the back surfaces of the bulged straw sections of the spare belt-shaped product to be positioned and is made of silicone rubber with multiple vacuum air pores ($28_1$), ($28_1$) formed at prescribed positions in the width direction on the bottom and lower parts of the shallow slots. The back surfaces of the bulged straw sections of the new starting end (d') of the spare belt-shaped product (D') are held by suction from the inside of positioning piece and positioned, and the cellophane tape (T) attached to the lip of the new starting end is also stably held by suction (see FIG. 4). In this way, when the new terminal end (d) of the belt-shaped product (D) in use is held and travels to the left between the press block (15) and retaining piece, the new terminal-end section adheres to the adhering surface of the cellophane tape (T) for an accurate connection between new and old belt-shaped product.

The procedure of connecting the starting end of the waiting spare belt-shaped product to the terminal end of the flowing belt-shaped product using the present invention, will now be described. The "old" belt-shaped product (D) is successively paid out from a continuous roll (the figure shows a small diameter only for illustrative purposes) rolled on reel (R) on a roll support shaft (not illustrated) of the main unit, and is conveyed to straw-attaching device for packaging containers.

Figure 1:
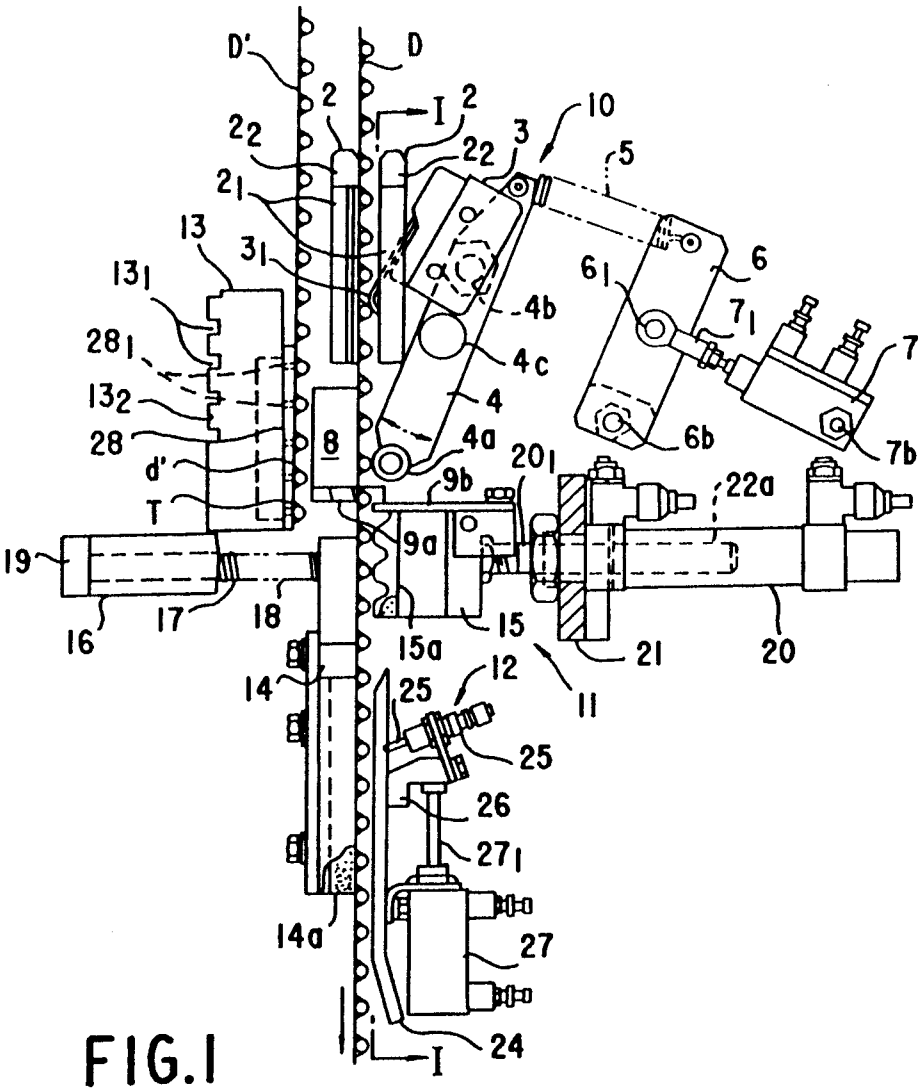
FIG. 1 is a front view of an apparatus according to the present invention with the spare belt-shaped product in a standby mode.

The old belt-shaped product is conveyed between a pair of facing guide pieces (2), (2), which are located on the upper part of the connecting apparatus as shown in FIG. 1, and between braking and positioning roller (4*a*) of the terminal-end braking means (10) and support block (8) across from the pathway. The belt-shaped product proceeds between the press block (15) of the cutting means and retaining piece (14), and between the lower part of the retaining piece and the guide plates (24) equipped on the back surfaces with the terminal-end positioning means (12). The belt-shaped product is cut into individual packages (A) in subsequent operation processes which are not a part of this invention.

The spare belt-shaped product (D') is rolled on a spare reel (R) from which it is paid out. Starting end section (d') thereof is disposed at a position near the conveying pathway of the belt-shaped product in use. The bulged sections of starting end (d') are initially fit into the slots ($13_1$), ($13_1$) of the jig of the starting-end positioning piece (13) for the spare belt-shaped product and the flat section between the lower bulged sections is cut with a cutting blade (N) at the cutting slot ($13_2$) (see FIG. 3). Cellophane tape (T) is then attached on the back surface of the cut lower end of spare belt-shaped product (D') such that it protrudes slightly at the lip as shown in FIG. 4. Spare belt-shaped product (D') is then brought to a prescribed position and held to the vacuum surface of vacuum plate (28), as a stand-by position (see FIG. 4). In this situation, the handle valve (not illustrated), is actuated to provide vacuum for the vacuum plate (28).

The operation of the main unit thus advances until the terminal end of the belt-shaped product (D) in use passes between the pair of guide pieces (2), (2), whereby the micro switch (3) detects this occurrence and starts the supply operation of new belt-shaped product (D') . Cylinder (7) of the terminal-end braking device (10) is activated upon receiving a signal from the micro switch (3). Upon return of the piston (travel to right in FIGS. 1 and 5), the braking and positioning lever (4) rotates clockwise via the linking lever (6) and spring (5), and the braking and positioning roller (4*a*) fits in between bulged sections of the belt-shaped product (D) and presses the belt-shaped product to provide braking. The terminal end of the belt-shaped product is thereby positioned and stopped. Small cylinder (25) of the terminal-end positioning means (12) is then activated to advance the interacting pins ($25_1$) of the piston-rod leading end toward the bulged sections of the belt-shaped product, and hook the pins thereupon. Because the small cylinder (25) is mounted via slide block (26) on the leading end of the piston rod ($27_1$) of the lower cylinder (27), the return of the piston rod ($27_1$) upon cylinder (27) activation also lowers the small cylinder (25). This operation pays out belt-shaped product (D) in an amount equal to one cylinder stroke, and completes the positioning of the belt-shaped product by pulling the product downward (see FIG. 5, illustrating movement of belt-shaped product in progress).

Cylinder (20) of the means (11) for cutting and separating the terminal end and pressing the new terminal end is then activated. Mobile blade (9*b*) , which moves with piston (20), of cylinder (20), shears between the bulged sections of the belt-shaped product at its prescribed position against the upper fixed blade (9a) located on the lower end surface of the support block (8). This removes the previously curled portion of the terminal end, and allows the new terminal end (d) of the belt-shaped product (D) to be conveyed to the lower part of the spare belt-shaped product (D') waiting on the vacuum plate (28). The connection of the new terminal end (d) formed on the old belt-shaped product (D) is completed by allowing attachment to the cellophane tape (T) surface attached to the starting end (d') of the spare belt-shaped product (D') (see FIG. 5). When the pressing and attachment is thus completed, the vacuum release lever (23) fastened to the terminal end of the guide rod (22b) toward the front of the aforesaid press block (15) enables the handle-valve to be driven. The vacuum suction at vacuum plate (28) of the starting-end positioning piece (13) is thereby shut off, and the connected belt-shaped product can be peeled away from the vacuum plate and is easily moved to the conveying pathway for belt-shaped product in operation.

After the transfer, the valve is returned to provide the vacuum plate (28) with a vacuum in order to form the starting end of space belt-shaped product.

Repeating the aforesaid operation enables belt-shaped product to be continuously connected. As described above, while the main unit is in operation, the apparatus places the starting end of subsequent belt-shaped product (D') on the vacuum plate (28) surface of the starting-end positioning piece (13) before the belt-shaped product (D) runs out. The apparatus automatically cuts the curled section on the terminal end of the belt-shaped product in use, and connects the waiting belt-shaped product stably and accurately.

The present invention provides the following beneficial effects: When the belt-shaped product is consumed, and new belt-shaped product is connected for continuous supply, the problems caused by the residual curling at the terminal end of the belt-shaped product ordinarily paid out from a roll are eliminated. The cutting and separating of the curled terminal end of the belt-shaped product, and forming of a new terminal end, enables easy connection to the starting end of spare belt-shaped product. This eliminates the problems typically caused by the curled condition at the terminal end of the belt-shaped product, and allows automatic connecting of new and old continuous packaging in a stable manner to supply to the main-unit mechanical section.

The installation of a braking and positioning roller of the terminal-end braking means to advance and recede freely via a spring at the conveying pathway of the belt-shaped product allows braking of the belt-shaped product without putting excessive force on the belt-shaped product. The braking and positioning roller fits in between bulged sections of the conveyed belt-shaped product, thereby allowing the transfer of the connected belt-shaped product from the connecting position to the conveying pathway in operation by removing the roller from the pathway by a spring action.

The terminal-end positioning means of the belt-shaped product is arranged to move and interact with the bulged sections of the belt-shaped product in the conveying direction by an interacting piece driven to advance and recede diagonally relative to the conveying direction of the belt-shaped product, for the processes beyond the terminal-end positioning means. The new terminal end is formed accurately by the cutting and removing of the curled terminal-end portion of the belt-shaped product. Slack is created for processes beyond the terminal-end positioning means; no interruption occurs since the slack portion provides a buffer of belt-shaped product while the spare product is being connected. As a result of these features, a dancer roller is not required. Accurate and smooth pressing can be performed by the new terminal-end pressing means.

The cutting means provides the movement of a mobile cutting piece which can perform easy and accurate connection operations by one reciprocation thereof. The new terminal end, formed simultaneously with shearing belt-shaped product in use, can be pressed onto the starting end of the spare belt-shaped product in a positive position by accommodating the bulged sections with slots furnished on the mobile piece.

The slots for the bulged sections formed on the starting-end positioning piece for the spare belt-shaped product, and the cutting slot, allow the connecting lip to be formed easily and accurately thereupon. The newly formed starting end, having cellophane tape attached thereto, is then positioned and attached to the vacuum surface on the other side of the slotted surface. The connecting of the newly formed terminal end of the belt-shaped product in use to the starting end of the spare belt-shaped product can therefore be accomplished accurately and efficiently.

The above description is provided for illustrative purposes only. The scope of the invention is defined by the following claims.

What is claimed is:

1. An apparatus for adhesively splicing a terminal end portion of a first web section to a starting end portion of a second web section to form a continuous packaging web having regularly spaced packaging bulges on one surface, comprising:

braking means for braking the terminal end portion of said first web section at a braking position located on a conveying pathway of the web, said braking means including a braking and positioning roller disposed to contact the belt-shaped product between the bulged sections at regular pitch intervals; and driving means activated in response to signals from said detection means for driving said braking means, wherein said braking and positioning roller freely advances and recedes at the conveying pathway via spring means;

detection means coupled to said braking means for detecting the terminal end portion of the first web section;

positioning means including interacting means for interacting with and moving the bulged sections in the conveying direction, said interacting means being driven diagonally relative to the conveying direction of the belt-shaped product, wherein said positioning means positions the terminal end portion at a prescribed position downstream from the braking position on the web pathway by tensioning and positioning the terminal end portion with interactive movement between the bulged sections and said interacting means;

cutting means for cutting and separating the terminal end portion of said first web section and, forming a new terminal end portion, said cutting means cutting and separating the terminal end of the first web section by movement of a mobile cutting piece, starting-end positioning means for positioning the adhesively-covered starting end portion of the second web section, said starting end positioning means being located adjacent to said braking means, and including a cutting section to cut the starting end of the second web section between adjacent packaging bulges, and including a suction means for positioning the adhesively-covered starting end portion by suction against a retaining surface, retaining means for retaining the position of the new terminal end portion and for orthogonally displacing it in a conveying direction and pressing and connecting said new terminal end portion onto said starting end portion of said second web section;

a mobile cutting piece which reciprocates orthogonally relative to the conveying direction, said mobile cutting piece having multiple slots of a prescribed pitch disposed to accommodate the bulged sections, and a pressing means for moving said new terminal end portion into adhesive connection with said starting end portion.

2. An automatic connecting apparatus for continuous packaging as recited in claim 1, wherein said terminal-end positioning means further includes:

a mobile piece disposed to reciprocate said interacting means in a direction parallel to a conveying direction of the belt-shaped product, wherein said interactive means is mounted to a leading edge of said mobile piece; and a retaining piece disposed adjacent to the conveying pathway, said retaining piece freely advancing or receding by pressure from a spring, wherein said retaining piece is facingly opposed to said interacting piece, wherein said interacting means and said mobile piece tensions and positions the belt-shaped product, while forming a slack portion of belt-shaped product beyond the terminal-end positioning means.

3. An automatic connecting apparatus for continuous packaging as recited in claim 2, wherein said cutting means further comprises:

a fixed blade and a mobile blade on opposing sides of the conveying pathway of the belt-shaped product, wherein said mobile blade is fastened to said mobile cutting piece, and accommodates a cut and formed new terminal end of belt-shaped product to enable pressing onto the starting end of the spare belt-shaped product between the mobile piece and a retaining piece while simultaneously shearing the belt-shaped product.

4. An automatic connecting apparatus for continuous packaging as recited in claim 3, wherein the starting end positioning means comprises:

a suction surface parallel and facing the conveying pathway, said suction surface for positioning and holding by suction the cut starting end of said second web section having cellophane tape attached thereto;

a second surface with multiple slots of a prescribed pitch thereon, said multiple slots for accommodating the bulged sections of said second web section, said second surface also having a cutting slot formed thereon to cut and form the starting end of said second web section at prescribed positions between said slots.

5. An automatic connecting apparatus for continuous packaging as recited in claim 22, wherein the starting end positioning means comprises:

a suction surface parallel and facing the conveying pathway, said suction surface for positioning and holding by suction the cut starting end of said second web section having cellophane tape attached thereto;

a second surface with multiple slots of a prescribed pitch thereon, said multiple slots for accommodating the bulged sections of said second web section, said second surface also having a cutting slot formed thereon to cut and form the starting end of said second web section at prescribed positions between said slots.

6. An automatic connecting apparatus for continuous packaging as recited in claim 1, wherein the starting end positioning means comprises:

a suction surface parallel and facing the conveying pathway, said suction surface for positioning and holding by suction the cut starting end of said second web section having cellophane tape attached thereto;

a second surface with multiple slots of a prescribed pitch thereon, said multiple slots for accommodating the bulged sections of said second web section, said second surface also having a cutting slot formed thereon to cut and form the starting end of said second web section at prescribed positions between said slots.

7. A splicing apparatus for a continuous packaging web having regularly spaced bulged wavelike sections on a front surface thereof, comprising:

braking means for braking a terminal end portion of the web at a braking position located on a conveying pathway of the web;

detecting means coupled to said braking means for detecting a terminal end of said terminal end portion of the web and providing signals to the braking means;

forwarding and positioning means equipped with operation pins for forwarding a downstream portion of the web located downstream from said braking position along the web pathway by a prescribed distance after said braking means braked the terminal end portion of the web and for positioning said downstream portion of the web thereat with said operation pins, which act against the front surface of the web having the bulged wavelike sections;

a retaining means disposed on an opposite side to said forwarding and positioning means about the web pathway for supporting a rear surface of the web;

cutting and positioning means, including a suction plate parallel to the web pathway, wherein said cutting and positioning means is located adjacent to said braking means for cutting a starting end portion of a spare web at a cutting section to form a new starting end portion and for positioning and holding said new starting end portion of the spare web on a surface of said suction plate; and cutting and pressing means, including a press block, wherein said cutting and pressing means is positioned between said braking means and said forwarding and positioning means for cutting and separating the terminal end portion to form a new terminal end portion of the web by a transverse movement of said press block to the web pathway and for pressing and connecting a terminal end of the new terminal end portion of the web onto a starting end of the new starting end portion of the spare web held on the suction plate by said transverse movement of said press block while said new terminal end portion of the web is held between said press block and the retaining means having guide rods arranged in the transverse direction to the web pathway;

the retaining means extending from the opposite side of the forwarding and positioning means to the opposite side of the cutting and pressing means about the web pathway;

and the guide rods being slidable in said transverse direction along holes provided in guide blocks arranged in said transverse direction.

8. A splicing apparatus for a continuous packaging web having regularly spaced bulged wavelike sections on a front surface thereof as recited in claim 7, wherein the braking means for braking a terminal end portion of the web comprises:

a first shaft located adjacent to the web pathway;

a braking and positioning lever pivotally movable about said first shaft adjacent to the web pathway, on a lower end of which braking and positioning rollers are provided;

a linking lever pivotally movable about a second shaft located on a lower end of the linking lever and arranged generally parallel to said braking and positioning lever;

spring means which connects an upper end of the braking and positioning lever to an upper end of the linking lever; and a support block disposed on an opposite side to the braking and positioning rollers about the web pathway;

driving means for rotating the linking lever about the second shaft in the clockwise direction, such that the braking and positioning rollers via said spring means presses the web against said support block, said driving means activated in response to signals from said detecting means, wherein said braking and positioning rollers freely advance and recede at the conveying pathway with said spring means until said driving means rotates the linking lever in response to the signals.

9. A splicing apparatus for a continuous packaging web having regularly spaced bulged wavelike sections on a front surface thereof as recited in claim 8, wherein the forwarding and positioning means equipped with operation pins includes:

small cylinders for driving the operation pins in a diagonal direct ion to the web pathway; and an air cylinder for driving the operation pins and said small cylinders in a parallel direction to the web pathway, wherein said operation pins and small cylinders are mounted to a leading edge of said air cylinder and said operation pins press the web against the retaining means diagonally and forward the downstream portion of the web to a downstream of the web pathway by the prescribed distance, and said retaining means for supporting the downstream portion of the web along the web pathway includes springs for biasing said retaining means, wherein said springs are mounted on the guide rods and when the cutting and pressing means moves and pushes in the transverse direction said retaining means recedes against a force exerted by said springs to a position where the new terminal end portion of the web aligns the new starting end portion of the spare web.

10. A splicing apparatus for a continuous packaging web having regularly spaced bulged wavelike sections on a front surface thereof as recited in claim 9, wherein said cutting and pressing means positioned between the braking means and the forwarding and positioning means comprises:

a mobile blade positioned on the press block for cutting and separating the terminal end portion of the web to form the new terminal end portion with a fixed blade provided on an opposing side of said mobile blade about the web pathway;

an air cylinder for moving the press block in the transverse direction of the web pathway; and a slotted rubber section provided on said press block having a regularly spaced plurality of slots adapted to accommodate the bulged wavelike sections on the front surface of the web.

11. A splicing apparatus for a continuous packaging web having regularly spaced bulged wavelike sections on a front surface thereof as recited in claim 8, wherein said cutting and pressing means positioned between the braking means and the forwarding and positioning means comprises:

a mobile blade positioned on the press block for cutting and separating the terminal end portion of the web to form the new terminal end portion with a fixed blade provided on an opposing side of said mobile blade about the web pathway;

an air cylinder for moving the press block in the transverse direction of the web pathway; and a slotted rubber section provided on said press block having a regularly spaced plurality of slots adapted to accommodate the bulged wavelike sections on the front surface of the web.

12. A splicing apparatus for a continuous packaging web having regularly spaced bulged wavelike sections on a front surface thereof as recited in claim 7, wherein the forwarding and positioning means equipped with operation pins includes:

small cylinders for driving the operation pins in a diagonal direction to the web pathway; and an air cylinder for driving the operation pins and said small cylinders in a parallel direction to the web pathway, wherein said operation pins and small cylinders are mounted to a leading edge of said air cylinder and said operation pins press the web against the retaining means diagonally and forward the downstream portion of the web to a downstream of the web pathway by the prescribed distance, and said retaining means for supporting the downstream portion of the web along the web pathway includes springs for biasing said retaining means, wherein said springs are mounted on the guide rods and when the cutting and pressing means moves and pushes in the transverse direction said retaining means recedes against a force exerted by said springs to a position where the new terminal end portion of the web aligns the new starting end portion of the spare web.

13. A splicing apparatus for a continuous packaging web having regularly spaced bulged wavelike sections on a front surface thereof as recited in claim 7, 8, 12, 9, 11, wherein said cutting and positioning means located adjacent to the braking means comprises:

regularly spaced plurality of slots formed in the cutting section on an opposite surface of said cutting and positioning means to the suction plate and adapted for accommodating the bulged wavelike sections of the spare web;

a cutting groove provided between adjacent said slots for cutting the starting end portion of the spare web to form the new starting end portion by tracing a knife along said cutting groove; and regularly spaced plurality of shallow slots formed on the surface of the suction plate and adapted for accommodating and holding rear sides of the bulged wavelike sections of the spare web by means of suction force, wherein the terminal end of the new terminal end portion of the web can be connected to the starting end of the new starting end portion with an adhesive tape attached on the starting end of the new starting end portion.

* * * * *